US008546049B2

(12) United States Patent
Kihara et al.

(10) Patent No.: US 8,546,049 B2
(45) Date of Patent: Oct. 1, 2013

(54) ELECTROPHOTOGRAPHIC PHOTOCONDUCTOR AND IMAGE FORMING APPARATUS USING THE SAME

(75) Inventors: Akiko Kihara, Osaka (JP); Akihiro Kondoh, Osaka (JP); Takatsugu Obata, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/325,486

(22) Filed: Dec. 14, 2011

(65) Prior Publication Data

US 2012/0156600 A1 Jun. 21, 2012

(30) Foreign Application Priority Data

Dec. 21, 2010 (JP) ..... 2010-284622

(51) Int. Cl.
*G03G 5/047* (2006.01)

(52) U.S. Cl.
USPC ..... 430/58.85; 399/159

(58) Field of Classification Search
USPC ..... 430/58.85; 399/159
See application file for complete search history.

(56) References Cited

U.S. PATENT DOCUMENTS

| | | | | |
|---|---|---|---|---|
| 3,824,099 | A | 7/1974 | Champ et al. | |
| 4,123,269 | A | 10/1978 | Von Hoene et al. | |
| 4,150,987 | A | 4/1979 | Anderson et al. | |
| 4,338,388 | A | 7/1982 | Sakai et al. | |
| 4,367,273 | A | 1/1983 | Murayama et al. | |
| 4,892,949 | A | 1/1990 | Sasaki | |
| 5,804,344 | A | 9/1998 | Mitsumori | |
| 6,210,847 | B1 | 4/2001 | Miyauchi et al. | |
| 2008/0166642 | A1* | 7/2008 | Obata et al. | 430/58.7 |

FOREIGN PATENT DOCUMENTS

| | | |
|---|---|---|
| JP | 54-151955 | 11/1979 |
| JP | 2-190862 | 7/1990 |
| JP | 7-048324 | 2/1995 |
| JP | 10-073936 | 3/1998 |
| JP | 2002-275135 | 9/2002 |

* cited by examiner

*Primary Examiner* — Peter Vajda
(74) *Attorney, Agent, or Firm* — Nixon & Vanderhye P.C.

(57) ABSTRACT

An electrophotographic photoconductor comprising a charge generation layer containing a charge generation material and a charge transfer layer containing a charge transfer material laminating in this order on a conductive support with an undercoat layer interposed between the charge generation layer and the conductive support, or comprising a monolayer type photosensitive layer containing a charge generation material and a charge transport material being formed on a conductive support with an undercoat layer interposed between the monolayer type photosensitive layer and the conductive support, wherein the charge transport layer or the monolayer type photosensitive layer contains, as a charge transfer material, a bisamine compound represented by the following general formula (I):

(I)

6 Claims, 2 Drawing Sheets

ELECTROPHOTOGRAPHIC PHOTOCONDUCTOR AND IMAGE FORMING APPARATUS USING THE SAME

CROSS-REFERENCE TO RELATED APPLICATION

This application is related to Japanese Patent Application No. 2010-284622 filed on 21 Dec. 2010, whose priority is claimed under 35 USC §119, and the disclosure of which is incorporated by reference in its entirety.

BACKGROUND OF THE INVENTION

1. Field of the Invention

The present invention relates to an electrophotographic photoconductor in which a bisamine compound having a specific bisbutadiene structure is included in a photosensitive layer formed on a conductive support, and an image forming apparatus.

2. Description of the Related Art

In recent years, organic photoconductive materials are pit on wide-ranging studies and researches. The organic photoconductive materials not only are used for electrophotographic photoconductors (hereinafter, also referred to as simply "photoconductor"), but also have become used in applications of electrostatic recording devices, sensor materials or organic electro luminescent (abbreviation: EL) devices. Further, the electrophotographic photoconductor using the organic photoconductive material is used not only for the copier field, but also for the fields of printing plates, slide films and micro films, where a photographic technology is heretofore used, and is also applied to high-speed printers using laser, a light emitting diode (abbreviation: LED) or a cathode ray tube (abbreviation: CRT) as a light source. Therefore, requirements of the organic photoconductive material and the electrophotographic photoconductor using the organic photoconductive material are becoming highly advanced and widely spread.

Hitherto, as the electrophotographic photoconductor, widely used are inorganic photoconductors which are provided with a photosensitive layer containing, as its major component, an inorganic photoconductive material such as selen, zinc oxide or cadmium. The inorganic photoconductor has fundamental characteristics required as photoconductors to some extent. However, the inorganic photoconductor has a drawback such that it has a difficulty in forming a film of the photosensitive layer, is deteriorated in plasticity and has high production cost. Also, the inorganic photoconductive materials are highly toxic in general and are therefore largely limited in its production and handling.

On the other hand, an organic photoconductor using the organic photoconductive material has advantages that a film formation property of the photoconductive layer is good, flexibility is high, and the photoconductor is lightweight and highly transparent, and a photoconductor, which exhibits a good sensitivity for a wide-ranging wavelength region by an appropriate sensitizing method, can be easily designed, and therefore the organic photoconductor is being developed as mainstreams of the electrophotographic photoconductor. The organic photoconductor had defects in a sensitivity and a durability early, but these defects are outstandingly improved by a development of a function separated electrophotographic photoconductor in which a charge generation function and a charge transport function are shared on separate materials respectively. The function separated electrophotographic photoconductor also has an advantage that each of a charge generation material bearing the charge generation function and a charge transport material bearing the charge transport function can be selected from wide-ranging materials and a electrophotographic photoconductor having any characteristic can be relatively easily prepared.

As the charge generation material to be used in these function separation type photoconductors, studies have been made as to various materials such as a phthalocyanine pigment, a squalilium dye, an azo pigment, a perylene pigment, a polycyclic quinone pigment, a cyanine dye, a squaric acid dye and a pyrylium salt-based dye, and a variety of materials having a high light fastness and a high charge generation ability have been proposed.

On the other hand, as the charge transport material, there are known various compounds such as pyrazoline compounds (e.g., see Japanese Examined Patent Publication No. 52-4188), hydrazone compounds (e.g., see Japanese Unexamined Patent Publication No. 54-150128, Japanese Examined Patent Publication No. 55-42380 and Japanese Unexamined Patent Publication No. 55-52063), triphenylamine compounds (e.g., see Japanese Examined Patent Publication No. 58-32372 and Japanese Unexamined Patent Publication No. 2-190862) and stilbene compounds (e.g., see Japanese Unexamined Patent Publication No. 54-151955 and Japanese Unexamined Patent Publication No. 58-198043). In recent years, pyrene derivatives, naphthalene derivatives and terphenyl derivatives (e.g., see Japanese Unexamined Patent Publication No. 7-48324), which have condensed polycyclic hydrocarbons as a central mother nucleus, are developed.

The following items of the charge transport material are required:

(1) to be stable against light and heat;

(2) to be stable against ozone, nitrogen oxide (NOx) and nitric acid respectively generated by corona discharge in charging a surface of the photoconductor;

(3) to have a high charge transport ability;

(4) to have a high compatibility with an organic solvent or agent; and (5) to be easily and economically produced.

However, the above-mentioned charge transport materials satisfy a part of these requirements but do not satisfy all of the requirements at a high level.

Further, among these requirements, it is particularly required to have a high charge transport ability. For example, when a charge transport layer formed by dispersing the charge transport material together with a binder resin is a surface layer of the photoconductor, the charge transport material requires the high charge transport ability in order to secure a sufficient photoresponsivity. When the photoconductor is disposed in a copier or a laser beam printer for use, the surface layer of the photoconductor is necessarily partly shaved off by a contact member such as a cleaning blade or a charge roller. In order to enhance a durability of the copier or the laser beam printer, a surface layer resistant to these contact members, that is, a surface layer having a high printing durability, which is less shaved by these contact member, is required. Thus, if a content of the binder resin in the charge transport layer, the surface layer, is increased in order to strengthen the surface layer and improve the durability, the photoresponsivity is deteriorated. A reason for this is that since the charge transport ability of the charge transport material is low, the charge transport material in the charge transport layer is diluted as the content of the binder resin increases, and therefore the charge transport ability of the charge transport layer is further lowered to deteriorate the photoresponsivity. When the photoresponsivity is poor, a residual potential is increased and the photoconductor is used repeatedly with a surface potential of the photoconductor not adequately decreased, and therefore a surface charge of a part to be eliminated by exposure is not adequately eliminated and this causes troubles such as reduction in image quality at an early stage. Accordingly, in order to secure the sufficient photoresponsivity, the high charge transport ability of the charge transport material is required. Further, a material, which can secure an adequate printing durability while maintaining the high charge transport ability without increasing a ratio of the binder resin by firmly bonding to the binder resin, is required.

Moreover, recently, downsizing and speeding up of electrophotography apparatuses such as a digital copier and a printer are advanced, an increase in sensitivity according to speeding up is required as the photoconductor characteristics and a higher charge transport ability of the charge transport material is required. In a high-speed process, since a time between exposure and developing is short, a photoconductor having a high photoresponsivity is necessary. As described above, since the photoresponsivity depends on the charge transport ability of the charge transport material, also from this point of view, the charge transport material having a higher charge transport ability is required.

The inventors of the present invention have made studies concerning photoconductive materials having a high sensitivity, a high durability and a high wear resistance of the above objects, and as a result, found that a bisamine compound having a bisbutadiene structure represented by the following general formula (I) is useful, to complete the present invention.

Specifically, in accordance with the present invention, there is provided an electrophotographic photoconductor including a charge generation layer containing a charge generation material and a charge transfer layer containing a charge transfer material laminating in this order on a conductive support with an undercoat layer interposed between the charge generation layer and the conductive support, or including a monolayer type photosensitive layer containing a charge generation material and a charge transport material being formed on a conductive support with an undercoat layer interposed between the monolayer type photosensitive layer and the conductive support, wherein the charge transport layer or the monolayer type photosensitive layer contains, as a charge transfer material, a bisamine compound represented by the following general formula (I):

(I)

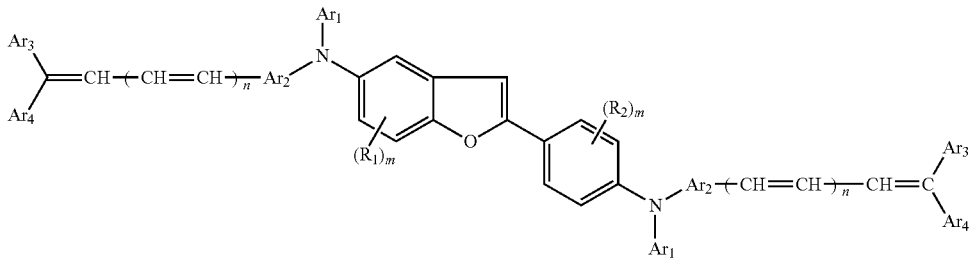

With respect to a charge transport material satisfying such requirements, as a compound having a higher charge mobility than the aforementioned charge transport material, a trial of a compound, in which a charge mobility of the charge transport material is increased by having a bisbutadiene structure in a molecule to expand a conjugated system in the molecule, is made (e.g., Japanese Unexamined Patent Publication No. 2002-275135 and Japanese Unexamined Patent Publication No. 9-244278).

However, even though various organic compounds are developed as the charge transport material like these, there is no organic compound overcoming all of the following problems such as:

1) a compatibility with a binding agent is low;
2) crystal is easily precipitated;
3) changes in sensitivity occur in the case of repetitive use;
4) a charging ability and a repetitive characteristic are low; and
5) a residual potential characteristic is poor.

It is a current status that an organic compound, which satisfies essential properties required as the photoconductor previously described, a mechanical strength and a high durability, is not yet adequately attained.

SUMMARY OF THE INVENTION

It is an object of the present invention to provide an electrophotographic photoconductor having a high sensitivity and a high durability, and an image forming apparatus.

wherein $Ar_1$s each represent an aryl, heteroaryl, aralkyl or heteroaralkyl group which may have a substituent, $Ar_2$s each represent and arylene or heterorylene group which may have a substituent, $Ar_3$s and $Ar_4$s may be the same or different and each represent a hydrogen atom or a alkyl or aryl group which may have a substituent, $R_1$ and $R_2$ may be the same or different and each represents a $C_1$ to $C_4$ alkyl, $C_1$ to $C_4$ alkoxy or $C_1$ to $C_4$ dialkylamino group which may have a halogen atom or a substituent, m is an integer of 0 to 4, and n is an integer of 1 to 4.

Also, in accordance with the present invention, there is provided the electrophotographic photoconductor, wherein the charge generation material contains oxotitanium phthalocyanine in which a Bragg angle ($2\theta \pm 0.2$ degree) in a Cu—K$\alpha$ characteristic X-ray diffraction (wavelength: 1.54 angstroms) has a clear diffraction peak at least at 27.2 degree.

Also, in accordance with the present invention, there is provided the electrophotographic photoconductor, wherein the charge transport layer further contains a binder resin, and in the charge transport layer, a ratio A/B (by mass) of the charge transport material (A) to the binder resin (B) is 10/12 or more and 10/30 or less.

Moreover, in accordance with the present invention, there is provided an image forming apparatus including the electrophotographic photoconductor, a charging means for charging the electrophotographic photoconductor, an exposure means for exposing the charged electrophotographic photoconductor with light to form an electrostatic latent image, a developing means for developing the electrostatic latent image to form a toner image, a transfer means for transferring the formed toner image to a medium, a cleaning means for removing and recovering a toner remaining on the photoconductor, a fixing means for fixing the toner image transferred to a medium to the medium and a charge-removing means for removing a surface charge remaining in the photoconductor.

When the bisamine compound represented by the general formula (I) according to the present invention is used, since the photoconductor has an excellent mechanical durability, a durability of the photoconductor can be improved without increasing a content of the binder resin at the expense of an electric characteristic as distinct from a case of using a common charge transport material.

Accordingly, it becomes possible to lengthen a lifetime of the electrophotographic photoconductor. Further, since the bisamine compound represented by the following compounds 1 to 5 can be easily produced, a productivity of the electrophotographic photoconductor can be improved.

Also, in accordance with the present invention, it is possible to provide a photoconductor which has a high charge characteristic and hardly causes a reduction in sensitivity also in a case of repetitive use. Further, it becomes possible to provide an image which is stable for a long period since a wear resistance of a surface of the photoconductor is excellent.

In accordance with the present invention, by containing the bisamine compound as the charge transport material, it is possible to provide an electrophotographic photoconductor having a high printing durability capable of providing an image which has a high sensitivity and a high responsivity and is stable for a long period. Also, in accordance with the present invention, it is possible to provide an electrophotographic photoconductor which has advantages of an organic-based photoconductor such that the organic-based photoconductor is highly transparent and lightweight and has an excellent film forming property and an ability to be positively and negatively charged and is easy to be produced, and has an excellent characteristic of hardly causing a reduction in photosensitivity even in repetitive use, and an image forming apparatus including the photoconductor.

DETAILED DESCRIPTION OF THE PREFERRED EMBODIMENTS

Figure 1:
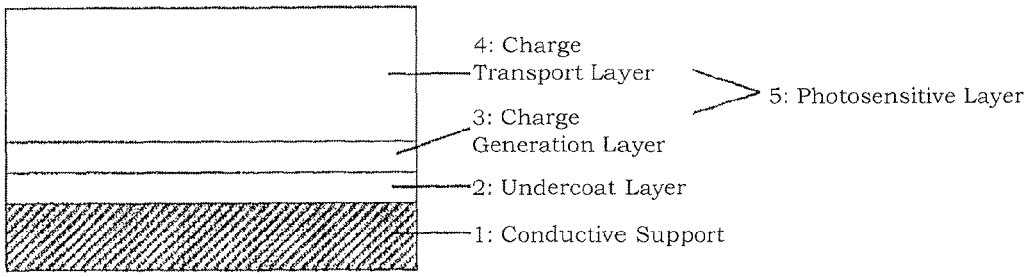
FIG. 1 is a schematic cross-sectional view showing a structure of an electrophotographic photoconductor of an example of an embodiment of the present invention.

The term "$C_1$ to $C_4$ alkyl group" used in the present invention means a straight or branched chain alkyl group having 1 to 4 carbon atoms.

Specific examples of the "C1 to C4 alkyl group" include methyl, ethyl, n-propyl, isopropyl, n-butyl and t-butyl group.

The term "$C_1$ to $C_4$ alkoxy group" used in the present invention means a straight or branched chain alkoxy group having 1 to 4 carbon atoms.

Specific examples of the "$C_1$ to $C_4$ alkoxy group" include methoxy, ethoxy, n-propoxy, isopropoxy, n-butoxy and t-butoxy group.

Further, the term "halogen atom" used in the present invention means fluorine, chlorine, bromine or iodine atom.

An electrophotographic photoconductor according to the present invention includes a charge generation layer containing a charge generation material and a charge transfer layer containing a charge transfer material laminating in this order on a conductive support with an undercoat layer interposed between the charge generation layer and the conductive support, or includes a monolayer type photosensitive layer containing a charge generation material and a charge transport material being formed on a conductive support with an undercoat layer interposed between the monolayer type photosensitive layer and the conductive support, wherein the charge transport layer or the monolayer type photosensitive layer contains, as a charge transfer material, a bisamine compound represented by the following general formula (I):

(I)

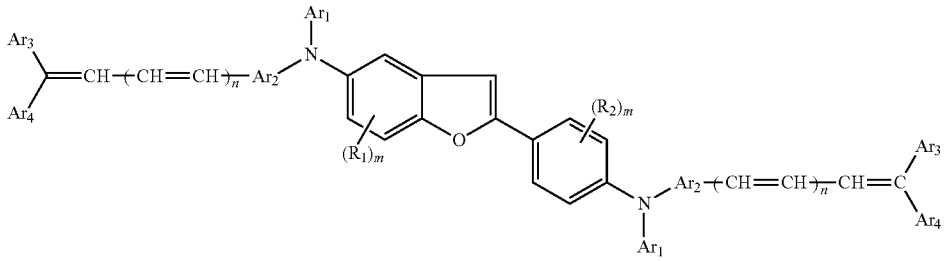

wherein, $Ar_1$s each represent an aryl, heteroaryl, aralkyl or heteroaralkyl group which may have a substituent, $Ar_2$s each represent an arylene or heteroarylene group which may have a substituent, $Ar_3$s and $Ar_4$s may be the same or different and each represent a hydrogen atom or an alkyl or aryl group which may have a substituent, $R_1$ and $R_2$ may be the same or different and each represents a $C_1$ to $C_4$ alkyl, $C_1$ to $C_4$ alkoxy or $C_1$ to $C_4$ dialkylamino group which may have a halogen atom or a substituent, m is an integer of 0 to 4, and n is an integer of 1 to 4.

In the general formula (I), $Ar_1$s each represent an aryl, heteroaryl, aralkyl or heteroaralkyl group which may be substituted with one or more halogen atoms, or one or more straight or branched chain $C_1$ to $C_4$ alkyl or $C_1$ to $C_4$ alkoxy groups, $Ar_1$s each are an arylene or heteroarylene group which may be substituted with one more substituents, whose substituent is halogen atom, or one or more straight or branched chain $C_1$ to $C_4$ alkyl or $C_1$ to $C_4$ alkoxy groups, $R_1$ and $R_2$ may be the same or different and each represents a $C_1$ to $C_3$ alkyl, $C_1$ to $C_3$ alkoxy or $C_1$ to $C_3$ dialkylamino group which may be substituted with one or more halogen atoms, or one or more straight or branched chain $C_1$ to $C_4$ alkyl or $C_1$ to $C_4$ alkoxy groups, and m is an integer of 0 to 4 and n is an integer of 1 to 4.

Specifically, in the general formula (I), $Ar_1$s each represent a phenyl or naphthyl group which may be substituted with one or more halogen atoms, or one or more straight or branched chain $C_1$ to $C_4$ alkyl or $C_1$ to $C_4$ alkoxy groups, $Ar_2$s each are an arylene group selected from the group consisting of phenylene, naphthylene and biphenylene which may be substituted with one or more halogen atoms, or one or more straight or branched chain $C_1$ to $C_4$ alkyl or $C_1$ to $C_4$ alkoxy groups; or each are a heteroallylene group selected from the group consisting of furylene, thienylene and thiazolylene which may be substituted with one or more halogen atoms, or one or more straight or branched chain $C_1$ to $C_4$ alkyl or $C_1$ to $C_4$ alkoxy groups, $Ar_3$s and $Ar_4$s may be the same or different and each are a hydrogen atom, or a straight or branched chain $C_1$ to $C_4$ alkyl group which may be substituted with one or more substituents, whose substituent is halogen atom, or one or more straight or branched chain $C_1$ to $C_4$ alkyl or $C_1$ to $C_4$ alkoxy groups; or an aryl group selected from the group consisting of a phenyl, naphthyl and biphenyl group which may be substituted with one or more halogen atoms, or one or more straight or branched chain $C_1$ to $C_4$ alkyl or $C_1$ to $C_4$ alkoxy groups, $R_1$ and $R_2$ are respectively an alkyl group selected from the group consisting of a methyl, ethyl, n-propyl, isopropyl, n-butyl and t-butyl group which may be substituted with halogen atom, and m is an integer of 0 or 1 and n is an integer of 1 to 4.

More specifically, in the general formula (I), $Ar_1$s each represent a phenyl or naphthyl group, $Ar_2$s each are a phenylene or naphthylene group which may be substituted with methyl, ethyl, methoxy or ethoxy group, $Ar_3$s and $Ar_4$s may be the same or different and each are a hydrogen atom, or a phenyl or naphthyl group which may be substituted with one or more halogen atoms, or one or more straight or branched chain $C_1$ to $C_4$ alkyl or $C_1$ to $C_4$ alkoxy groups, $R_1$ and $R_2$ are respectively an alkyl group selected from the group consisting of methyl, ethyl, n-propyl, isopropyl, n-butyl and t-butyl group which may be substituted with halogen atom, and m is an integer of 0 or 1 and n is an integer of 1 to 4.

Furthermore specifically, in the general formula (I), $Ar_1$s each represent a phenyl group, $Ar_2$s each are 1,4-phenylene, 2-methyl-1,4-phenylene, 3-methyl-1,4-phenylene or 1,4-naphthylene group, $Ar_3$s and $Ar_4$s may be the same or different and each are hydrogen atom or phenyl group, and m is 0 and n is an integer of 1 or 2.

Specific examples of each substituent in the bisamine compound represented by the general formula (I) of the present invention are shown in the following table, but the bisamine compound of the present invention is not limited thereto.

TABLE 1

| Compound | $Ar_1$ | N—$Ar_2$ | $Ar_3$ | $Ar_4$ | $R_1$ | $R_2$ | m | n |
|---|---|---|---|---|---|---|---|---|
| 1 | 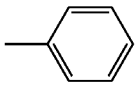 | 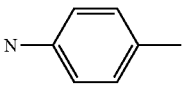 | 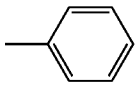 | H | (H) | (H) | 0 | 1 |
| 2 | 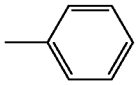 | 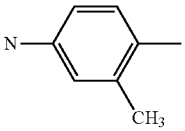 | 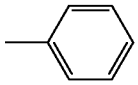 | H | (H) | (H) | 0 | 1 |
| 3 | 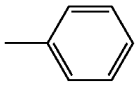 | 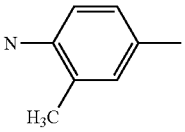 | 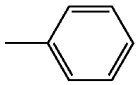 | H | (H) | (H) | 0 | 1 |
| 4 | 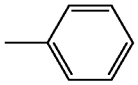 | 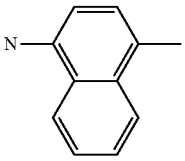 | 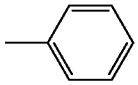 | H | (H) | (H) | 0 | 1 |
| 5 | 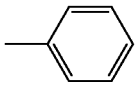 | 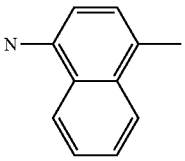 | 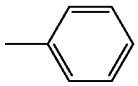 | H | (H) | (H) | 0 | 2 |

More specific bisamine compounds represented by the general formula (I) are compounds having the following structural formula.
TABLE 2
| Compound | Structural formula |
|---|---|
| 1 | 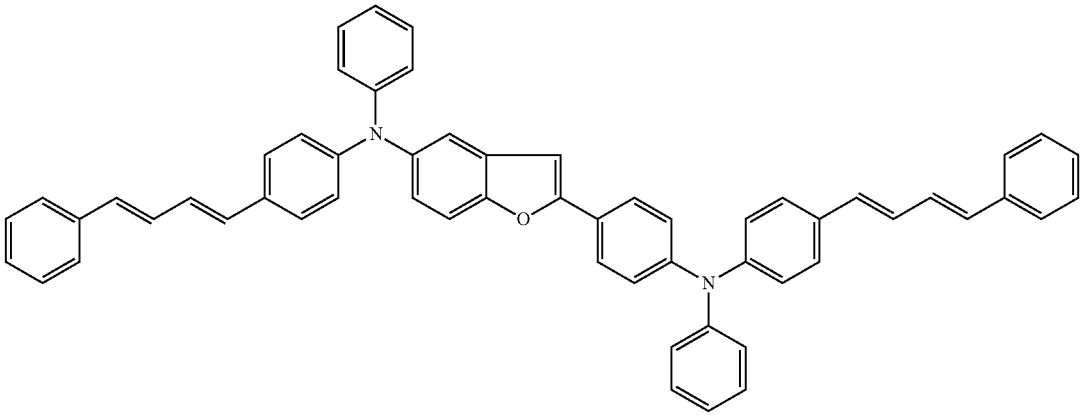 |
| 2 | 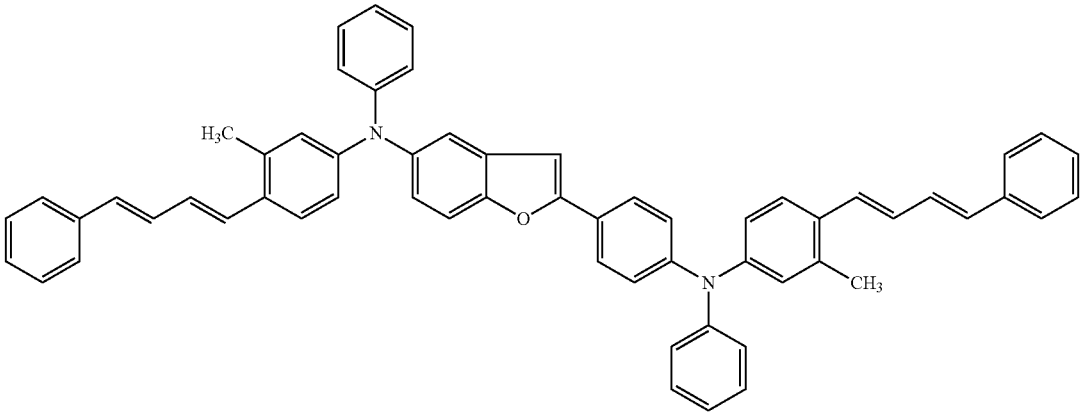 |
| 3 | 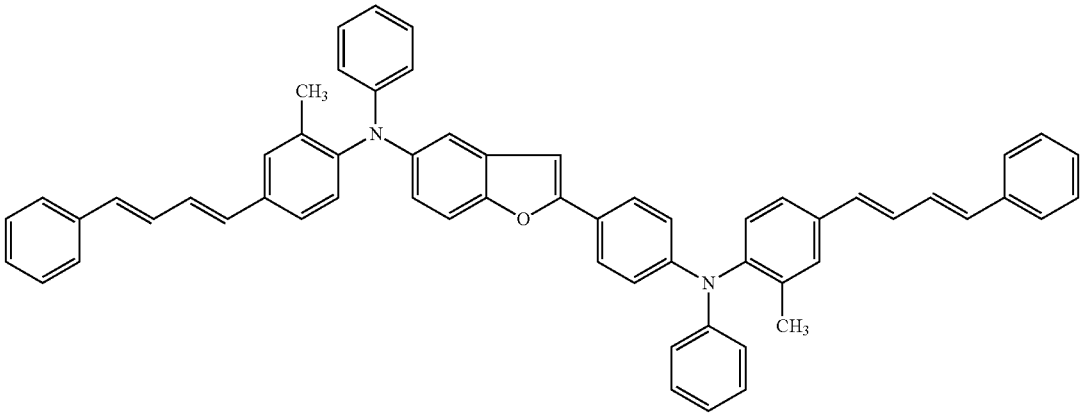 |

TABLE 2-continued

| Compound | Structural formula |
|---|---|
| 4 | 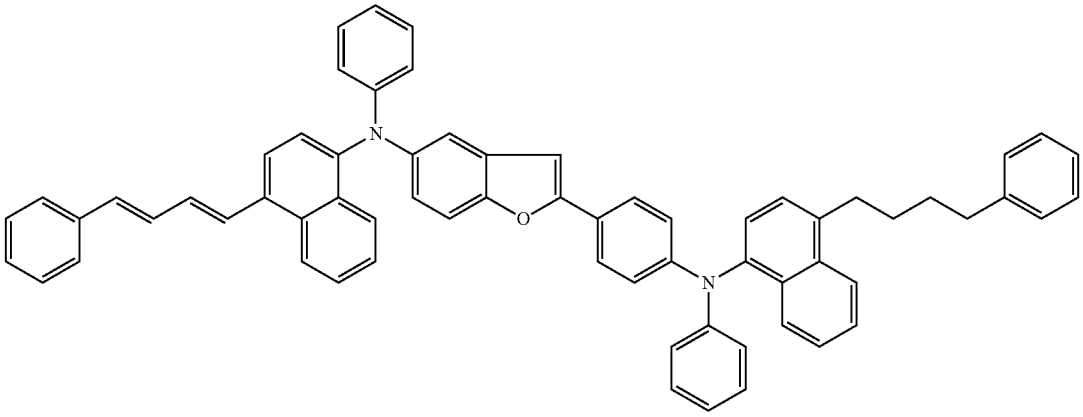 |
| 5 | 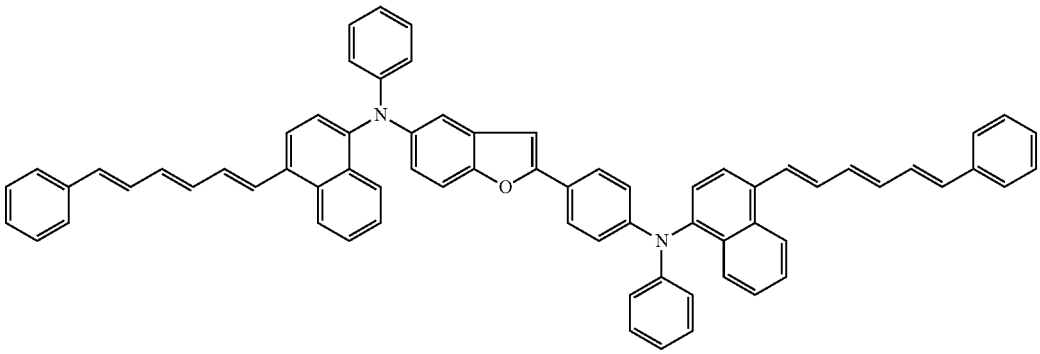 |

In addition, compounds 3 and 4 of the bisamine compounds described in the above table have an excellent electrophotographic characteristic in the electrophotographic photoconductor and an extremely excellent wear resistance of the electrophotographic photoconductor.

The bisamine compound represented by the general formula (I) can be synthesized by various methods, and in general, the bisamine compound can be easily synthesized by the following synthesis process.

According to a synthesis method described in Japanese Unexamined Patent Publication No. H09 (1997)-179319, synthesized was a bisamine compound represented by the general formula (II):

(II)

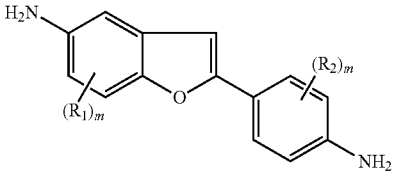

wherein $R_1$, $R_2$ and m are as defined in the above general formula (I).

Hereinafter, the synthesis method will be described with reference to a compound 1 as an example.

Production Example 1-1

Production of Amino Compound A

By following a synthesis process described in Japanese Unexamined Patent Publication No. H09 (1997)-179319, synthesized was an amino compound A represented by the following formula (A):

(A)

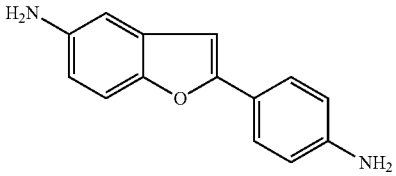

Synthesis of 2-(p-aminophenyl)-5-aminobenzofurane

More specifically, 10.0 g (1.0 equivalent) of 5-nitrosalicylalhehyde and 13.3 g (1.03 equivalents) of p-nitrobenzylbromide were dissolved in 45 ml of 1,4-dioxane, to which, 12.5 ml (1.2 equivalents) of N,N-diisopropylethylamine was added, and the resulting mixture was heated and stirred at about 100° C. for 2 hours. The reaction mixture was cooled to room temperature, and the produced solid was separated by filtration and washed adequately with ethanol to obtain 16.74 g of 2-(p-nitrobenzyloxy)-5-nitrobenzalhehyde at an yield of 92.7%.

Then, 16.09 g (1.0 equivalent) of 2-(p-nitrobenzyloxy)-5-nitrobenzalhehyde thus obtained was dissolved in 50 ml of 1,4-dioxane, to which, 9.7 g (1.3 equivalents) of 1,8-diazabicyclo[5,4,0]undec-7-ene was added, and the resulting mixture was heated and stirred at 100° C. for 3 hours. The reaction mixture was cooled to room temperature, and the produced solid was separated by filtration and washed adequately with ethanol to obtain 12.42 g of 2-(p-nitrophenyl)-5-nitrobenzofurane at an yield of 82%.

Then, 12.42 g (1.0 equivalent) of the obtained 2-(p-nitrophenyl)-5-nitrobenzofurane was added to 48.85 g (20.0 equivalents) of a 100 mesh iron powder previously activated by 0.5 ml of concentrated hydrochloric acid in 150 ml of a mixed solvent of 1,4-dioxane and water in proportions of 1:1, and the resulting mixture was refluxed by heating at about 110° C. for 2 hours and heavily stirred. The hot supernatant was filtered with Celite immediately after confirming a completion of the reaction by TLC (Thin-Layer Chromatography). The residual material was adequately washed with hot 1,4-dioxane and filtered. This operation was repeated three or four times, and then filtrates were combined and concentrated by an evaporator. After concentration, recrystallization was carried out with ethanol to obtain 7.1 g of orange-colored 2-(p-aminophenyl)-5-aminobenzofurane (amino compound A) at an yield of 90%.

The obtained white powdery compound was analyzed with LC-MS, and consequently, a peak corresponding a molecular ion $[M+H]^+$ obtained by adding a proton to the amine compound A (theoretical molecular weight: 224.1) was observed at 765.3 as a main peak of a mass spectrum.

Further, it was found from a result of analysis by LC-MS that a purity of the obtained compound A was 99.4%.

The elemental analysis of the obtained compound A was carried out by using a simultaneous quantification procedure of carbon (C), hydrogen (H), nitrogen (N) and oxygen (O) according to a differential thermal conductivity method. In the following production examples, the same method is used.

Elementary Analysis for Compound A:

Theoretical value C, 74.98%; H, 5.39%; N, 12.49%; O; 7.13%

Experimental value C, 74.92%; H, 5.36%; N, 13.46%; O; 7.11%

It was verified from the above results that the obtained crystal was a compound of the amine compound A.

Production Example 1-2

Production of Amine Compound B

The amino compound A (7.1 g) (1.0 equivalent) obtained in Production Example 1-1 described above, iodobenzene (13.5 g) (2.1 equivalents), copper (8.1 g) (4.0 equivalents), potassium carbonate (34.8 g) (8.0 equivalents), 18-crown-6 (1.7 g) (0.2 equivalents) and 300 ml of o-dichlorobenzene were reacted for 12 to 24 hours under reflux by heating to obtain, at an yield of 92%, an amine compound B (11.1 g) represented by the following formula (B):

(B)

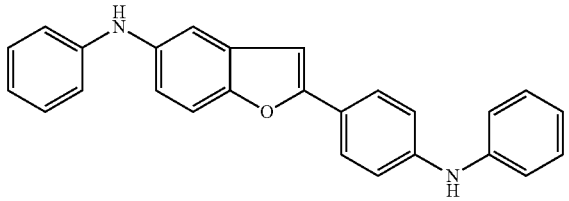

Production Example 1-3

Production of Butadiene Compound D

First, 4-bromobenzaldehyde (9.5 g) (1.0 equivalent) and a Wittig reagent C (17.9 g) (1.1 equivalents) represented by the following formula (C):

(C)

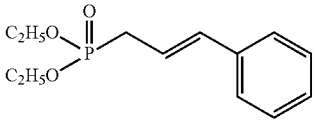

were dissolved in 80 ml of DMF anhydride. To the solution, potassium t-butoxide (15.2 g) (2 to 2.5 equivalents) was added gradually at 0° C. Thereafter, the resulting mixture was left standing at room temperature for 1 hour, and heated to 50° C. and stirred for 5 hours while heating at the same temperature. The reaction mixture was cooled and then poured into excessive methanol. The precipitate was recovered and dissolved in toluene to form a toluene solution. The toluene solution was poured into a separating funnel and washed with water, and then an organic layer was taken out and the organic layer taken out was dried over magnesium sulfate. After drying, the organic layer, from which a solid substance was removed, was concentrated and subjected to silica gel column chromatography to obtain a butadiene compound D (17.8 g) represented by the following formula (D):

(D)

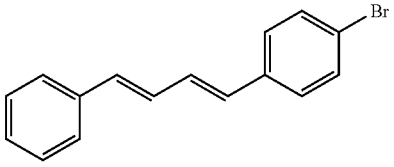

Production Example 1-4

Production of Bisamine-Bisbutadiene Compound 1

The amino compound B (11.1 g) (1.0 equivalent) obtained in Production Example 1-2 described above, the butadiene compound D (17.4 g) (2.1 equivalents) obtained in Production Example 1-3 described above, copper (7.5 g) (4.0 equivalents), potassium carbonate (32.2 g) (8.0 equivalents), 18-crown-6 (1.5 g) (0.2 equivalents) and 300 ml of o-dichlorobenzene were reacted for 12 to 24 hours under reflux by heating to obtain, at an yield of 95%, a compound 1 (20.6 g) represented by the following formula (1):

(1)

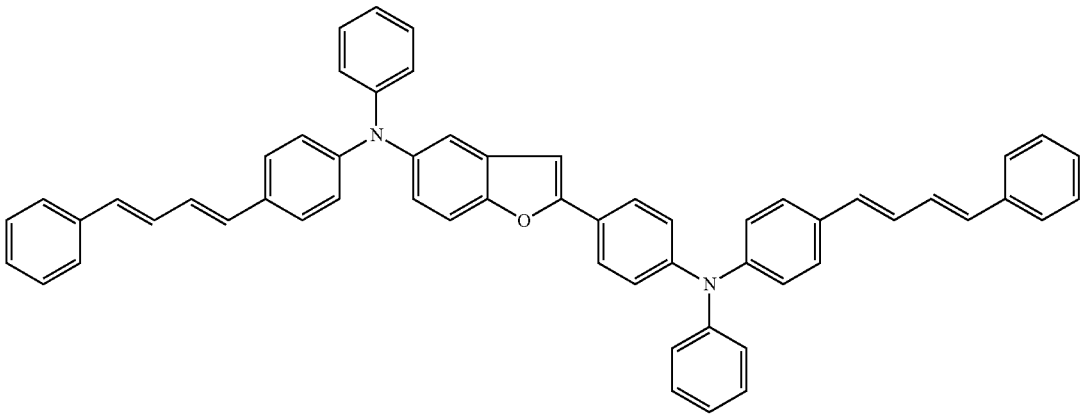

The obtained white powdery compound was analyzed with LC-MS, and consequently, a peak corresponding a molecular ion $[M+H]^+$ obtained by adding a proton to the compound 1 (theoretical molecular weight: 760.0) was observed at 761.2 as a main peak of a mass spectrum.

Further, it was found from a result of analysis by LC-MS that a purity of the obtained compound 1 was 99.1%.

The elemental analysis of the obtained compound 1 was carried out by using a simultaneous quantification procedure of carbon (C), hydrogen (H), nitrogen (N) and oxygen (O) according to a differential thermal conductivity method. In the following production examples, the same method is used.

Elementary Analysis for Compound 1:

Theoretical value C, 88.39%; H, 5.83%; N, 3.68%; O; 2.1%

Experimental value C, 88.30%; H, 5.82%; N, 3.66%; O, 2.0%

It was verified from the above results that the obtained crystal was a compound of the compound 1.

Production Example 2

Production of Compound 2

A compound 2 was synthesized in the same manner as in Production Example 1-3 except for reacting 4-bromo-2-methylbenzaldehyde (13.2 g) in place of 4-bromobenzaldehyde in Production Example 1-3.

The obtained white powdery compound was analyzed with LC-MS, and consequently, a peak corresponding a molecular ion $[M+H]^+$ obtained by adding a proton to the compound 2 (theoretical molecular weight: 789.0) was observed at 761.2 as a main peak of a mass spectrum.

Further, it was found from a result of analysis by LC-MS that a purity of the obtained compound 2 was 99.5%.

The elemental analysis of the obtained compound 2 was carried out by using a simultaneous quantification procedure of carbon (C), hydrogen (H), nitrogen (N) and oxygen (O) according to a differential thermal conductivity method. In the following production examples, the same method is used.

Elementary Analysis for Compound 2:

Theoretical value C, 88.29%; H, 6.13%; N, 3.55%; O, 2.03%

Experimental value C, 88.22%; H, 6.09%; N, 3.49%; O, 2.00%

It was verified from the above results that the obtained crystal was a compound of the compound 2.

Production Example 3

Production of Compound 3

A compound 3 was synthesized in the same manner as in Production Example 1-3 except for reacting 4-bromo-3-methyl-benzaldehyde (13.2 g) in place of 4-bromobenzaldehyde in Production Example 1-3.

The obtained white powdery compound was analyzed with LC-MS, and consequently, a peak corresponding a molecular ion $[M+H]^+$ obtained by adding a proton to the compound 3 (theoretical molecular eight 789.0) was observed at 790.2 as a main peak of a mass spectrum.

Further, it was found from a result of analysis by LC-MS that a purity of the obtained compound 3 was 99.6%.

The elemental analysis of the obtained compound 3 was carried out by using a simultaneous quantification procedure of carbon (C), hydrogen (H), nitrogen (N) and oxygen (O) according to a differential thermal conductivity method. In the following production examples, the same method is used.

Elementary Analysis for Compound 3:

Theoretical value C, 88.29%; H, 6.13%; N, 3.55%; O, 2.03%

Experimental value C, 88.26%; H, 6.09%; N, 3.51%; O, 2.00%

It was verified from the above results that the obtained crystal was a compound of the compound 3.

Production Example 4

Production of Compound 4

A compound 4 was synthesized in the same manner as in Production Example 1-3 except for using the following production method in place of the production method in a synthesis of the butadiene compound in Production Example 1-3.

Production of Butadiene Compound F

First, 1-bromo-4-methylnaphthalene was brominated by reacting 1-bromo-4-methylnaphthalene (13.2 g) (1.0 equivalent) with bromine (5.0 g) (0.5 equivalents) under ultraviolet irradiation to obtain, at an yield of 95%, a brominated compound F (17 g) (1.0 equivalent) represented by the following formula (F):

(F)

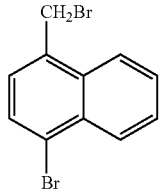

Production of Butadiene Compound G

The above brominated compound F (17 g) (1.0 equivalent) and the Wittig reagent C (15 g) (1.1 equivalents) represented by the following formula (C):

(C)

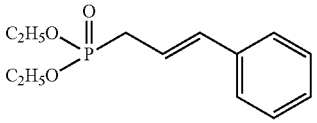

were dissolved in 80 ml of DMF anhydride. To the resulting solution, potassium t-butoxide (12.7 g) (2 to 2.5 equivalent) was added gradually at 0° C. Thereafter, the resulting mixture was left standing at room temperature for 1 hour, and heated to 50° C. and stirred for 5 hours while heating at the same temperature. A reaction mixture was cooled and then poured into excessive methanol. A precipitate was recovered and dissolved in toluene to form a toluene solution. The toluene solution was poured into a separating funnel and washed with water, and then an organic layer was taken out and the organic layer taken out was dried over magnesium sulfate. After drying, the organic layer, from which a solid substance was removed, was concentrated and subjected to silica gel column chromatography to obtain, at an yield of 96%, a butadiene compound G (21.3 g) represented by the following formula (G):

(G)

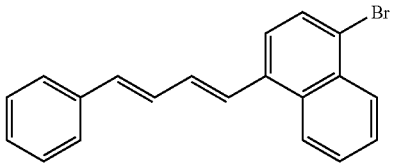

A compound 4 was synthesized in the same manner as in Production Example 1-4 except for reacting the butadiene compound G (20.5 g) (2.1 equivalents) in place of the butadiene compound D of the compound 1 in Production Example 1-4.

The obtained white powdery compound was analyzed with LC-MS, and consequently, a peak corresponding a molecular ion $[M+H]^+$ obtained by adding a proton to the compound 4 (theoretical molecular weight: 816.1) was observed at 817.2 as a main peak of a mass spectrum.

Further, it was found from a result of analysis by LC-MS that a purity of the obtained compound 4 was 99.8%.

The elemental analysis of the obtained compound 4 was carried out by using a simultaneous quantification procedure of carbon (C), hydrogen (H), nitrogen (N) and oxygen (O) according to a differential thermal conductivity method. In the following production examples, the same method is used.

Elementary Analysis for Compound 4:

Theoretical value C, 88.31%; H, 6.30%; N, 3.43%; O, 1.96%

Experimental value C, 88.28%; H, 6.19%; N, 3.39%; O, 1.93%

It was verified from the above results that the obtained crystal was a compound of the compound 4.

Production Example 5

Production of Compound 5

A compound 5 was synthesized in the same manner as in Production Example 4 except for using, in place of the Wittig reagent C in Production Example 4, a Wittig reagent H (16.6 g) represented by the following formula (H):

(H)

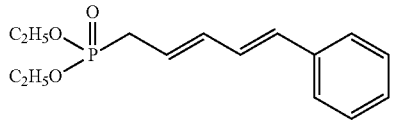

The obtained white powdery compound was analyzed with LC-MS, and consequently, a peak corresponding a molecular ion $[M+H]^+$ obtained by adding a proton to the compound 5 (theoretical molecular weight: 866.4) was observed at 867.6 as a main peak of a mass spectrum.

Further, it was found from a result of analysis by LC-MS that a purity of the obtained compound 5 was 99.7%.

The elemental analysis of the obtained compound 5 was carried out by using a simultaneous quantification procedure of carbon (C), hydrogen (H), nitrogen (N) and oxygen (O) according to a differential thermal conductivity method. In the following production examples, the same method is used.

Elementary Analysis for Compound 5:

Theoretical value C, 88.65%; H, 6.8%; N, 3.23%; O, 1.85%

Experimental value C, 88.60%; H, 6.27%; N, 3.21%; O, 1.81%

It was verified from the above results that the obtained crystal was a compound of the compound 5.

[Laminate Type Photosensitive Layer 5]

A laminate type photosensitive layer 5 includes a charge generation layer 3 and a charge transport layer 4. When a charge generation function and a charge transport function are respectively borne by separate layers like this, an optimum material can be independently selected for each layer of these layers.

A laminate type photosensitive layer (FIG. 1) in which a charge generation layer and a charge transfer layer are laminated in this order will be described below, and a reverse double layered laminate type photosensitive layer (FIG. 2) only differs in a lamination order from the laminate type photosensitive layer and is basically similar to the laminate type photosensitive layer.

[Charge Generation Layer 3]

A charge generation layer contains a charge generation material having a charge generation ability which generates charges by absorbing irradiated light as a main component, and arbitrarily contains publicly known additives and a binder resin (binding agent).

As the charge generation material, compounds used in the art can be used.

Specific examples of the charge generation material include azo-based pigments (monoazo-based pigments, bisazo-based pigments trisazo-based pigments and the like, which have a carbazole skeleton, a styryl-stilbene skeleton, a triphenylamine skeleton, a dibenzothiophene skeleton, an oxadiazole skeleton, a fluorenone skeleton, a bisstilbene skeleton, a distyryloxadiazole skeleton or a distyrylcarbazole skeleton); perylene-based pigments (peryleneimide, perylene acid anhydride and the like); polycyclic quinone-based pigments (quinacridone, anthraquinone, pyrene quinine and the like); phthalocyanine-based pigments (metal phthalocyanine, nonmetal phthalocyanine, halogenated nonmetal phthalocyanine and the like); indigo-based pigments (indigo, thioindigo and the like); organic pigments or dyes such as squalilium dyes, azlenium dyes, thiopyrylium dyes, pyrylium salts and triphenyl methane-based dyes, and inorganic materials such as selenium and amorphous silicon.

These charge generation materials may be used singly or in combination of two or more thereof.

Among these charge generation materials, phthalocyanine-based pigments, azo-based pigments and perylene-based pigments are particularly preferred since they have a high sensitivity.

The charge generation layer may contain appropriate amounts of one or two or more publicly known additives selected from chemical sensitizing agents, optical sensitizing agents, antioxidants, ultraviolet absorbers, dispersion stabilizers, sensitizing agents, leveling agents, plasticizers, fine particles of inorganic compounds or organic compounds. These additives may be contained in the charge transport layer described later, or may be contained in both of the charge generation layer and the charge transport layer.

Chemical sensitizing agents and optical sensitizing agents improves a sensitivity of the photoconductor, suppresses increases in a residual potential and fatigue due to repetitive use, and improves an electrical durability.

Examples of the chemical sensitizing agents include acid anhydrides such as succinic anhydride, maleic anhydride, phthalic anhydride and 4-chloronaphthalic anhydride; cyano compounds such as tetracyanoethylene and terephthalmalonic dinitrile; aldehydes such as 4-nitrobenzaldehyde; anthraquinones such as anthraquinone and 1-nitroanthraquinone; polycyclic or heterocyclic nitro compounds such as 2,4,7-trinitrofluorenone and 2,4,5,7-tetranitrofluorenone; and electron-attractive materials such as diphenoquinone compound and compounds obtained by increasing molecular weights of these electron-attractive materials.

Examples of the optical sensitizing agents include organic photoconductive compounds such as xanthene-based dyes, quinoline-based dyes and copper phthalocyanine; triphenylmethane-based dyes typified by Methyl Violet, Crystal Violet, Night Blue and Victoria Blue; acridine dyes typified by Erythrocin, Rhodamine B, Rhodamine 3R, Acridine Orange and Flapeocine; thiazine dyes typified by Methylene Blue and Methylene Green; oxazine dyes typified by Capri Blue and Meldola's Blue; cyanine dyes; styryl dyes; pyrylium salt dyes and thiopyrylium salt dyes.

Antioxidants can maintain a sensitive stability for a long period.

Examples of the antioxidant include phenolic antioxidants such as hindered phenol including 2,6-di-t-butyl-4-methylphenol(2,6-di-t-butyl-p-cresol: BHT), amine-based antioxidants such as hindered amine, vitamin E, hydroquinone, p-phenylenediamine, arylalkane and derivatives thereof, organic sulfuric compounds and organic phosphorus compounds, and these may be used singly or in combination of two or more thereof.

An amount of the antioxidant to be added is preferably 0.1 to 40 parts by weight, and particularly preferably 0.5 to 15 parts by weight with respect to 100 parts by weight of the charge generation material.

When the amount of the antioxidant to be added is less than 0.1 parts by weight, there may be cases where effects of improving a stability of a coating solution and a durability of the photoconductor are insufficient. Further, when the amount of the antioxidant exceeds 40 parts by weight, there may be cases where characteristics of the photoconductor are adversely affected.

Leveling agents and plasticizers can improve a film forming property, a flexibility and a surface smoothness.

Examples of the leveling agent include silicone-based leveling agents.

Examples of the plasticizer include dibasic acid esters such as phthalic acid esters, fatty acid esters, phosphate esters, chlorinated paraffine and epoxy type plasticizers.

Fine particles of an inorganic compound or an organic compound can enhance a mechanical strength and improve electric characteristics. Examples of such fine particles include fine particles exemplified in an intermediate layer described later.

The charge generation layer can be formed by publicly known dry processes or wet processes.

Examples of the dry process include a method of depositing the charge generation material on a surface of a conductive support by vacuum vapor deposition.

Examples of the wet process include a method in which the charge generation material, and an additive and a binder resin as required are dissolved or dispersed in an appropriate organic solvent to prepare an application solution for forming a charge generation layer, and the application solution is applied onto a surface of an intermediate layer formed on a conductive support, and then dried to remove the organic solvent.

Binder resins can improve a mechanical strength and durability of the charge generation layer and improve a binding property between layers, and resins having a binding property, which are used in the art, may be used.

Specific examples of the binder resin include thermoplastic resins such as polymethylmethacrylates, polystyrenes, vinyl-based resins such as polyvinyl chloride, polycarbonates, polyesters, polyester carbonates, polysulfones, polyarylates, polyamides, methacrylic resins, acrylic resins, polyethers, polyacrylamides and polyphenylene oxides; thermosetting resins such as epoxy resins, silicone resins, polyurethanes, phenolic resins, alkyd resins, melamine resins, phenoxy resins, polyvinylbutyrals and polyvinylformals, partially crosslinked products of these resins, copolymer resins containing two or more of structural units contained in these resins (insulating resins such as vinyl chloride-vinyl acetate copolymer resins, vinyl chloride-vinyl acetate-maleic acid anhydride copolymer resins and acrylonitrile-styrene copolymer resins). These binder resins may be used singly or in combinations of two or more thereof.

Though a mixing ratio between the charge generation material and the binder resin is not particularly limited, but in general, a content of the charge generation material is about 10 to 99%.

When the content of the charge generation material is less than 10% by weight, a sensitivity of the photoconductor may be deteriorated.

On the other hand, the content of the charge generation material exceeds 99% by weight, not only a film strength of the charge generation layer is reduced but also a dispersibility of the charge generation material may be deteriorated to increase coarse particles. Therefore, surface charges on a part other than a part to be eliminated by exposure are reduced, and image defects, particularly image fogs referred to as black dot which is a phenomenon in which toners are stuck to a white background to form fine black spots, may be increased.

Examples of the organic solvent include aromatic hydrocarbons such as benzene, toluene, xylene, mesitylene, tetralin, diphenylmethane, dimethoxybenzene and dichlorobenzene; halogenated hydrocarbons such as dichloromethane, dichloroethane and tetrachloropropane; ethers such as tetrahydrofuran (THF), dioxane, dibenzyl ether, dimethoxymethyl ether and 1,2-dimethoxyethane; ketones such as methyl ethyl ketone, cyclohexanone, acetophenone and isophorone; esters such as methyl benzoate, ethyl acetate and butyl acetate; sulfur-containing solvents such as diphenyl sulfide; fluorine-based solvents such as hexafluoroisopropanol; and aprotic polar solvents such as N,N-dimethylformamide and N,N-dimethylacetamide. These compounds may be used singly or in combinations of two or more thereof.

Also, mixed solvents obtained by adding alcohols, acetonitrile or methyl ethyl ketone to the above solvents may be used. Among these solvents, non-halogen-based organic solvents are suitably used in consideration of a global environment.

The charge generation material may be pre-milled prior to a process of dissolving or dispersing structural materials in a resin solution.

The pre-milling may be carried out by using a common milling machine such as a ball mill, a sand mill, an attritor, a vibration mill or an ultrasonic dispersing machine.

The dissolution or dispersion of the structural material in the resin solution may be carried out by using a common dispersing machine such as a paint shaker, a ball mill or a sand mill. At this time, it is preferable to appropriately set proper dispersing conditions so as to prevent impurities from being produced from members constituting a container or the dispersing machine by abrasion to be mixed in the application solution.

Examples of the method of applying the application solution for forming a charge generation layer include a Baker applicator method, a bar coating method, a casting method, a spin coating method, a roller method and a blade method in a case of a sheet, and include a spraying method, a vertical ring method and a dipping method in a case of a drum.

A temperature in a drying step of a coating film is not particularly limited as long as it is a temperature at which the used organic solvent can be removed, but a temperature of 50 to 140° C. is appropriate and a temperature of 80 to 130° C. is particularly preferred.

When a drying temperature is less than 50° C., a drying time may be lengthened. When the drying temperature exceeds 140° C., electric characteristics in a repetitive use of the photoconductor may be deteriorated and a resulting image may be degraded.

A film thickness of the charge generation layer s not particularly limited, but it is preferably 0.05 to 5 μm, and particularly preferably 0.1 to 1 μm. When the film thickness of the charge generation layer is less than 0.05 μm, an efficiency of light absorption is decreased and a sensitivity of the photoconductor may be deteriorated. On the other hand, when the film thickness of the charge generation layer exceeds 5 charge transporting within the charge generation layer becomes a rate-determining step of a process of eliminating charges on a surface of the photoconductor and therefore the sensitivity may be deteriorated.

[Charge Transport Layer]

The charge transport layer in the present invention primarily contains a binder resin and a triphenylamine compound represented by the general formula (I), more specifically a triphenylamine compound represented by any one of the above compounds (1) to (5), as a charge transport material.

In general, a ratio E/B of a weight E of the charge transport material to a weight B of the binder resin is 10/12 to 10/25, and preferably 10/16 to 10/20. When the ratio E/B is less than 10/25, since a relative weight ratio of the binder resin to the charge transport material is high, a sufficient sensitivity may not be attained. On the other hand, when the ratio E/B exceeds 10/12, a printing durability of the charge transport layer and a durability of the photoconductor may be deteriorated.

As the binder resin, one or two or more types of the same binder resin as that contained in the charge generation layer can be used. Among these resins, resins containing polycarbonate as a main component, polyarylate resins and polystyrene resins are preferable since they are photochemically stable and superior in compatibility with the charge transport material, and has a volume resistance of $10^{13}\Omega$ or more and hence excellent in electric insulation, and further has an excellent film forming property and a potential characteristic.

The charge transport layer may contain an appropriate amount of the additive similar to that contained in the charge generation layer as required within a range which does not inhibit effects of the present invention.

The charge transport layer can be formed by dissolving or dispersing the charge transport material, the binder resin and other additives as required in an appropriate organic solvent to prepare an application solution for forming a charge transport layer, applying the application solution onto a surface of the charge generation layer, and then drying a coating film to remove the organic solvent.

More specifically, the application solution for forming a charge transport layer is prepared, for example, by dissolving or dispersing the charge transport material and other additives as required in a resin solution obtained by dissolving the binder resin in an organic solvent.

Other steps and other conditions conform to those in a formation of the charge generation layer.

A film thickness of the charge transport layer is not particularly limited, but it is preferably 10 to 60 μm, and particularly preferably 10 to 40 μm. When the film thickness of the charge transport layer is less than 10 μm, a charge retentive ability of a surface of the photoconductor may be deteriorated, and on the contrary when the film thickness of the charge transport layer exceeds 60 μm, sharpness may be deteriorated or a residual potential may be increased and therefore an image may be significantly deteriorated.

[Monolayer Type Photosensitive Layer 5]

Figure 3:
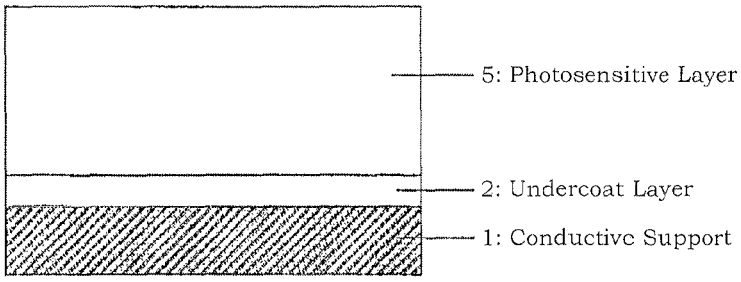
FIG. 3 is a schematic cross-sectional view showing a structure of an electrophotographic photoconductor of further example of an embodiment of the present invention.

A monolayer type photosensitive layer 5 shown in FIG. 3 contains the charge generation material, the charge transport material represented by the general formula (I) and the binder resin (binding agent) as main components.

The monolayer type photosensitive layer may contain an appropriate amount of the additive similar to that contained in the charge generation layer as required within a range which does not inhibit effects of the present invention.

The monolayer type photosensitive layer can be formed by dissolving and/or dispersing the charge generation material, the charge transport material and other additives as required in an appropriate organic solvent to prepare an application solution for forming a monolayer type photosensitive layer, applying the application solution onto a surface of an intermediate layer formed on a conductive support, and then drying a coating film to remove the organic solvent.

Other steps and other conditions conform to those in a formation of the charge generation layer and the charge transport layer.

A film thickness of the monolayer type photosensitive layer is not particularly limited, but it is preferably 10 to 100 μm, and particularly preferably 15 to 50 μm. When the film thickness of the monolayer type photosensitive layer is less than 10 μm, there is a fear that a charge retentive ability of a surface of the photoconductor may be deteriorated, and when the film thickness of the monolayer type photosensitive layer exceeds 100 there is a fear that a productivity may be deteriorated.

[Protective Layer (not Shown)]

Figure 2:
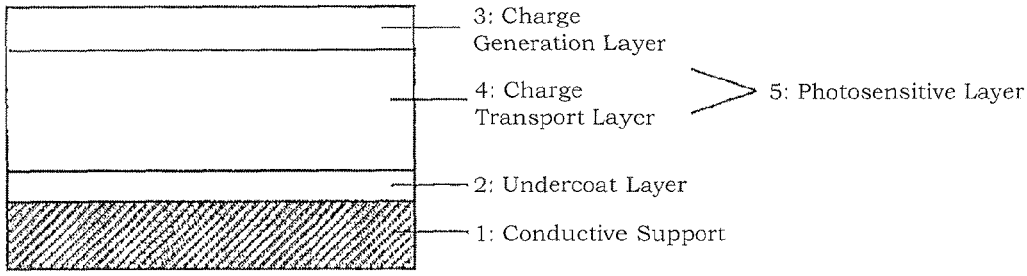
FIG. 2 is a schematic cross-sectional view showing a structure of an electrophotographic photoconductor of another example of an embodiment of the present invention.

The photoconductor of the present invention may include a protective layer (not shown) on a surface of the laminate type photosensitive layer 5 and a surface of the monolayer type photosensitive layer 5, shown in FIGS. 1 to 3.

The protective layer has a function of improving an abrasion property of the photosensitive layer and a function of preventing a chemical adverse effect due to ozone or nitrogen oxide.

The protective layer can be formed, for example, by dissolving or dispersing the binder resin and an additive such as an antioxidant or an ultraviolet absorber as required in an appropriate organic solvent to prepare an application solution for forming a protective layer, applying the application solution onto a surface of the monolayer type photosensitive layer or the laminate type photosensitive layer, and then drying a coating film to remove the organic solvent.

Other steps and other conditions conform to those in a formation of the charge generation layer.

A film thickness of the protective layer is not particularly limited, but it is preferably 0.5 to 10 μm, and particularly preferably 1 to 5 μm. When the film thickness of the surface protective layer is less than 0.5 μm, there is a fear that an abrasion resistance of a surface of the photoconductor may be deteriorated and a durability of the photoconductor may be insufficient, and on the contrary when the film thickness of the surface protective layer exceeds 10 μm, there is a fear that a resolution of the photoconductor may be deteriorated.

The image forming apparatus of the present invention includes at least the photoconductor of the present invention, a charging means for charging the photoconductor, an exposure means for exposing the charged photoconductor with light, a developing means for developing an electrostatic latent image formed by the exposure to form a toner image, a transfer means for transferring the developed toner image to a recording material, a fixing means for fixing the transferred toner image to the recording material to form an image, a cleaning means for removing and recovering a toner remaining on the photoconductor, and a charge-removing means for removing a surface charge remaining in the photoconductor.

The image forming apparatus of the present invention will be described with reference to drawings, but the image forming apparatus is not limited to contents of the following descriptions.

Figure 4:
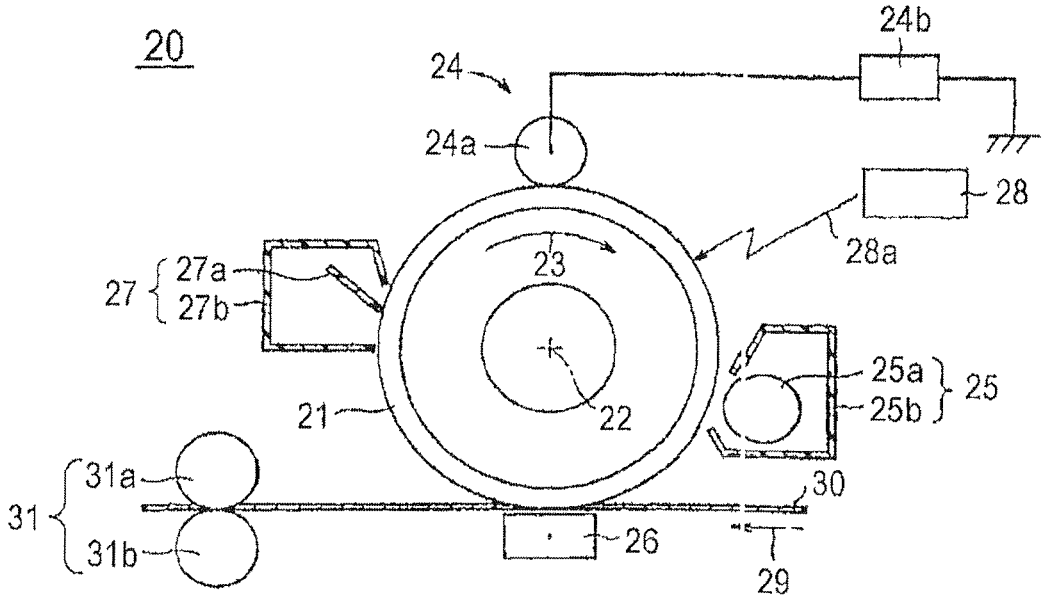
FIG. 4 is an arrangement side view schematically showing a structure of an image forming apparatus including a electrophotographic photoconductor according to the present invention.

FIG. 4 is a schematic side view showing a structure of the image forming apparatus of the present invention.

An image forming apparatus 20 of FIG. 4 is configured to include a photoconductor 21 (for example, any one of the photoconductors shown in FIGS. 1 to 3) of the present invention, a charge means (charger) 24, an exposure means 28, a developing means (developing unit) 25, a transfer means (transfer device) 26, a cleaning means (cleaner) 27, a fixing means (fixing device) 31, and a charge-removing means (not shown, disposed in the cleaning means together). Numeral 30 in the figure indicates a transfer paper.

The photoconductor 21 is supported by a body of the image forming apparatus 20 (not shown) in a rotatable manner and is rotated in a direction of an arrow 23 around a rotation axis 22 by a driving means (not shown).

The driving means has, for example, a structure including an electric motor and a reduction gear and transmits its driving force to a conductive support configuring a core body of the photoconductor 21 to thereby rotate the photoconductor 21 at a predetermined peripheral speed.

The charger 24, the exposure means 28, the developing unit 25, the transfer device 26 and the cleaner 27 are disposed in this order towards a down stream side from an upstream side in the rotation direction of the photoconductor 21 as shown by the arrow 23 along an outside peripheral surface of the photoconductor 21.

The charger 24 is a charging means for charging the outside peripheral surface of the photoconductor 21 to a predetermined potential. Specifically, for example, the charger 24 is embodied by a contact type charging roller 24*a*, a charging brush or a charger wire such as a corotron or a scorotron. A numeral 24*b* indicates a bias power source.

The exposure means 28 includes, for example, semiconductor laser as a light source and irradiates a part between the charger 24 of the photoconductor 21 and the developing unit 25 with an exposure light 28*a* such as laser beams emitted from the light source to expose the outside peripheral surface of the charged photoconductor 21 with light according to image information. The photoconductor 21 is scanned repeatedly by the exposure light 28*a* in a major scanning direction parallel to the rotation axis 22 of the photoconductor 21 and along with this scanning, an electrostatic latent image is formed on a surface of the photoconductor 21 in order.

The developing unit 25 is a developing means for developing, with a developer, the electrostatic latent image formed on the surface of the photoconductor 21 by exposure. The developing unit 25 is disposed facing the photoconductor 21, and provided with a developing roller 25*a* which supplies a toner to the outside peripheral surface of the photoconductor 21 and a casing 25*b* which supports the developing roller 25*a* rotatably around a rotating axis parallel to the rotating axis 22 of the photoconductor 21 and which stores a developer containing the toner in its inside space.

The transfer device 26 is a transfer means to transfer a toner image, which is a visible image formed on the outside peripheral surface of the photoconductor 21 by development, to the transfer paper 30 which is a recording medium supplied between the photoconductor 21 and the transfer device 26 from a direction of an arrow 29 by a conveying means (not shown). The transfer device 26 is, for example, a non-contact type transfer means which is provided with a charge means and provides charges having polarity opposite to that of the toner to the transfer paper 30 to thereby transfer the toner image to the transfer paper 30.

The cleaner 27 is a cleaning means which removes and recovers a toner remaining on the outside peripheral surface of the photoconductor 21 after a transfer operation by the transfer device 26. The cleaner 27 includes a cleaning blade 27*a* which peels the toner remaining on the outside peripheral surface of the photoconductor 21 and a recovery casing 27*b* which stores the toner peeled by the cleaning blade 27*a*. Also, this cleaner 27 is disposed together with a charge-removing lamp (not shown).

Further, the image forming apparatus 20 is provided with the fixing device 31 which is a fixing means for fixing the transferred image on a downstream side toward which the transfer paper 30 having passed between the photoconductor 21 and the transfer device 26 is conveyed. The fixing device 31 includes a heating roller 31*a* provided with a heating means (not shown) and a pressure roller 31*b* which is opposed to the heating roller 31*a* and pressed by the heating roller 31*a* to form a contact part.

An image formation operation of this image forming apparatus 20 is made as follows. First, when the photoconductor 21 is rotated in the direction of the arrow 23 by a driving means, the surface of the photoconductor 21 is positively or negatively charged uniformly to a predetermine potential by the charger 24 disposed on an upstream side of an image point of the exposure light 28*a* of the exposure means 28 in the rotation direction of the photoconductor 21.

Next, the surface of the photoconductor 21 is irradiated with the exposure light 28*a* according to image information emitted from the exposure means 28. In the photoconductor 21, surface charges on the part irradiated with the exposure light 28*a* are removed, which causes a difference in surface potential between the part irradiated with the exposure light 28*a* and the part not irradiated with the exposure light 28*a*, resulting in a formation of an electrostatic latent image.

A toner is supplied to the surface of the photoconductor 21 having the electrostatic latent image formed thereon from the developing unit 25 disposed on a downstream side of the image point of the exposure light 28*a* of the exposure means 28 in the rotation direction of the photoconductor 21, to develop the electrostatic latent image, thereby forming a toner image.

The transfer paper 30 is fed between the photoconductor 21 and the transfer device 26 synchronously with the exposure for the photoconductor 21. Charges having polarity opposite to that of the toner are added to the fed transfer paper 30 by the transfer device 26 to transfer the toner image formed on the surface of the photoconductor 21 to a surface of the transfer paper 30.

The transfer paper 30 with the toner image transferred thereto is conveyed to the fixing device 31 by a conveying means, and heated and pressurized when it passes through the contact part between the heating roller 31*a* and the pressure roller 31*b* of the fixing device 31 to fix the toner image to the transfer paper 30, thereby forming a fast image. The transfer paper 30 on which an image is thus formed is discharged out of the image forming apparatus 20 by a conveying means.

On the other hand, a toner remaining on the surface of the photoconductor 21 after the toner image is transferred by the transfer device 26 is peeled from the surface of the photoconductor 21 by the cleaner 27 and recovered. Charges on the surface of the photoconductor 21 from which the toner is thus removed is removed by light emitted from a charge-removing lamp, so that the electrostatic latent image on the surface of the photoconductor 21 disappears. Thereafter, the photoconductor 21 is further rotated and then, a series of operations beginning with the charging operation are again repeated to form images continuously.

Next, the present invention will be described in more detail by way of examples, but the present invention is not limited to these examples.

Example 1

An electrophotographic photoconductor was produced in which the compound 1 which was the bisamine compound produced in Production Examples 1-1 to 1-4 according to the present invention was used as a charge transport material of a charge transport layer was prepared in the following manner.

As a conductive support, a 100 μm thick polyethylene terephthalate (abbreviation: PET) film with aluminum deposited on its surface by vapor deposition (hereinafter, referred to as "aluminum deposited PET film") was used. Then, 7 parts by weight of titanium oxide (product name: Tipaque TTO55A, manufactured by Ishihara Sangyo Kaisha, Ltd.) and 13 parts by weight of a copolymer nylon resin (product name: Amilan CM8000, manufactured by Toray Industries, Inc.) were added to a mixed solvent of 159 parts by weight of methyl alcohol and 106 parts by weight of 1,3-dioxolane, and a resulting mixture was subjected to dispersion treatment using a paint shaker for 8 hours to prepare 100 g of an application solution for forming an intermediate layer. This application solution for forming an intermediate layer was applied onto an aluminum surface of the aluminum deposited PET film, which was a conductive support, by an applicator, and naturally dried to form an intermediate layer having a film thickness of 1 μm.

Then, 2 parts by weight of Y-type oxotitanium phthalocyanine (manufactured by Nippon Shizai Co., Ltd.) and 1 part by weight of a butyral resin (product name: #6000-C, manufactured by Denki kagaku Kogyo K. K.) were mixed in 98 parts by weight of methyl ethyl ketone and a resulting mixture was subjected to dispersion treatment using a paint shaker to prepare 50 g of an application solution for forming a charge generation layer. The application solution for forming a charge generation layer was applied onto a surface of the intermediate layer formed previously in the same manner as in the case of the above intermediate layer and naturally dried to form a charge generation layer having a film thickness of 0.4 μm.

Then, an application solution for a charge transport layer was prepared by dissolving, in 80 parts by mass of tetrahydrofuran (THF), 10 parts by weight of a compound of the compound 1 produced in Production Example 1 and 10 parts by mass of a polycarbonate resin (manufactured by Teijin Chemicals Ltd.: C-1400), in which 18 parts by weight of a polycarbonate resin (manufactured by Mitsubishi Engineering Plastics Corporation, product name: Iupilon 2400) as a binder resin; 0.5 parts by weight of 2,6-di-t-butyl-4-methylphenol as an antioxidant; and 0.004 parts by weight of dimethylpolysiloxane (manufactured by Shin-Etsu Chemical Co., Ltd.,: KF-96) as a leveling agent were dissolved in 110 parts by weight of THF as an organic solvent to prepare an application solution for forming a charge transport layer (total amount 1 kg). This application solution for a charge transport layer was applied onto the charge generation layer formed previously with a Baker applicator and then dried at 130° C. for 1 hour to form a charge transport layer having a film thickness of 23 μm. As describe above, a laminate type electrophotographic photoconductor having the structure shown in FIG. 1 was prepared.

Example 2

An electrophotographic photoconductor was prepared in the same manner as in Example 1 except for using the compound 2 obtained in Production Example 2 in place of the compound 1 used as a charge transport material in Example 1.

Example 3

An electrophotographic photoconductor was prepared in the same manner as in Example 1 except for using the compound 3 obtained in Production Example 3 in place of the compound 1 used as a charge transport material in Example 1.

Example 4

An electrophotographic photoconductor was prepared in the same manner as in Example 1 except for using the compound 4 obtained in Production Example 4 in place of the compound 1 used as a charge transport material in Example 1.

Example 5

An electrophotographic photoconductor was prepared in the same manner as in Example 1 except for using the compound 5 obtained in the Production Example 5 in place of the compound 1 used as a charge transport material in Example 1.

Example 6

An electrophotographic photoconductor was prepared in the same manner as in Example 1 except for using X-type nonmetal phthalocyanine (Fastogen Blue 8120, manufactured by Dainippon Ink and Chemicals, Inc.) in place of oxotitanium phthalocyanine as a charge generation material.

Comparative Example 1

An electrophotographic photoconductor was prepared in the same manner as in Example 1 except for using a compound 6 represented by the formula (6):

(6)

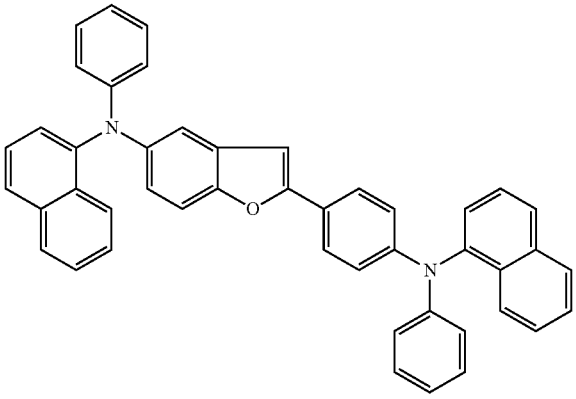

in place of the compound 1 as a charge transport material.

However, in this sample, an infinite number of micro crystals of the compound 7, which result from its poor compatibility, appear on a surface of a sheet after film forming/drying, and electric characteristics could not be evaluated well.

in place of the compound 1 as a charge transport material.

In addition, the compound 6 was synthesized by the following method.

The amino compound B (11.1 g) (1.0 equivalent) obtained in Production Example 1-2, 1-bromonaphthalene (13.5 g) (2.1 equivalents), copper (7.5 g) (4.0 equivalents), potassium carbonate (2.2 g) (8.0 equivalents), 18-crown-6 (1.5 g) (0.2 equivalents) and 300 ml of o-dichlorobenzene were reacted for 12 to 24 hours under reflux by heating to obtain a compound 6 (14.4 g) at an yield of 97%.

The obtained white powdery compound was analyzed with LC-MS, and consequently, a peak corresponding a molecular ion $[M+H]^+$ obtained by adding a proton to the compound 6 (theoretical molecular weight: 508.7) was observed at 709.9 as a main peak of a mass spectrum.

Further, it was found from a result of analysis by LC-MS that a purity of the obtained compound 6 was 99.5%.

The elemental analysis of the obtained compound 6 was carried out by using a simultaneous quantification procedure of carbon (C), hydrogen (H), nitrogen (N) and oxygen (O) according to a differential thermal conductivity method. In the following production examples, the same method is used.

Elementary Analysis for Compound 6:

Theoretical value C, 85.01%; H, 6.34%; N, 5.51%; O, 3.15%

Experimental value C, 84.98%; H, 6.31%; N, 5.47%; O, 3.12%

It was verified from the above results that the obtained crystal was a compound of the compound 6.

Comparative Example 2

An electrophotographic photoconductor was prepared in the same manner as in Example 1 except for using a compound 7 represented by the formula (7):

(7)

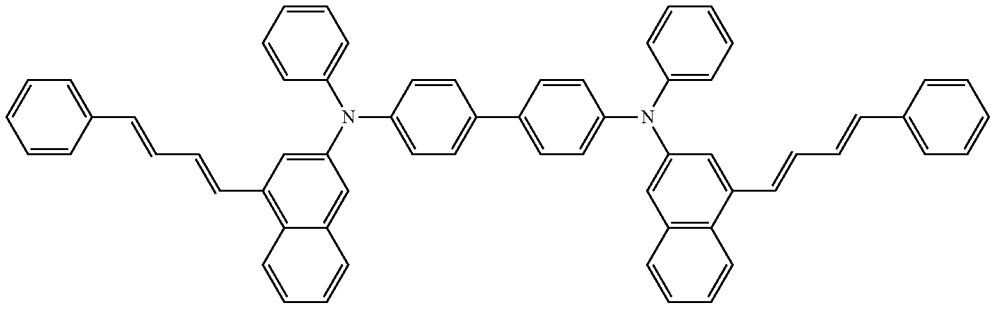

In addition, the compound 7 can be produced by the following method. A method, in which a compound α-Np-TPD (manufactured by TOKYO CHEMICAL INDUSTRY Co., Ltd.) having a triarylamine structure is used as a raw material, a publicly known reaction of introducing carbonyl is performed, and a Wittig reaction is performed, can be employed.

That is, first, α-Np-TPD (10 g) (1.0 equivalent) and a formylating agent (N,N-dimethylformamide, N-methylform anilide or the like) are subjected to an o-dichlorobenzene (4.9 g) (2.1 equivalents) reaction in the presence of phosphorous oxychloride (5.1 g) (2.1 equivalents) to obtain an arylamine-aldehide compound 8 represented by the following formula (8):

(8)

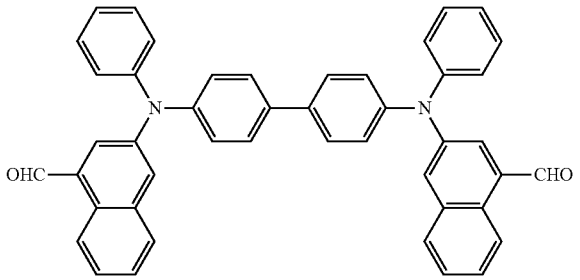

A compound 7 is obtained by reacting this compound 8 with the Wittig reagent C.

Comparative Example 3

An electrophotographic photoconductor was prepared in the same manner as in Example 1 except for changing a ratio A/B of a weight A of the charge transport material to a weight B of the binder resin to 10/11.

Comparative Example 4

An electrophotographic photoconductor was prepared in the same manner as in Example 1 except for changing the ratio A/B of the weight A of the charge transport material to the weight B of the binder resin to 10/35.

Evaluations of Examples 1 to 6 and Comparative Examples 1 to 4

(1) Electric Characteristic of Photoconductor

The photoconductors obtained in Examples 1 to 6 and Comparative Examples 1 to 4 were mounted respectively on a commercially available digital copier (model: MX-3100 FG, manufactured by Sharp Corporation) in which a surface potential meter (model: CATE 751, manufactured by GEN-TEC Co., Ltd.) was installed so that a surface potential of the photoconductor in the image formation process can be measured, and electric characteristics and environmental stability of the respective photoconductors were evaluated.

First, in an N/N circumstance of a temperature of 22° C. and a relative humidity of 65%, the surface potential of the photoconductor immediately after the photoconductor is charged by a charger was measured as a charge potential VO (V). Further, the surface potential of the photoconductor immediately after the photoconductor is exposed with a laser light (wavelength: 780 nm) was measured as a residual potential VL (V) in the N/N circumstance.

Next, in the N/N circumstance of a temperature of 22° C. and a relative humidity of 65%, after a test image with a given pattern (character test chart specified in ISO 19752) was continuously printed on 100000 recording sheets, the charge potential VO (V) as the surface potential of the photoconductor immediately after charging and the residual potential VL (V) as the surface potential of the photoconductor after exposure were measured in the same manner as in the case of the initial measurement. A difference between the initial residual potential and the residual potential after printing was determined as a potential variation ΔVLS (V) which is an index of a fatigue characteristic.

Also, in addition to the measurement in the N/N circumstance, the residual potential VL (V) in an L/L circumstance of a temperature of 5° C. and a relative humidity of 10% was measured.

(2) Evaluation of Printing Durability

An image exposure light source of a digital copier (AR-451S, manufactured by Sharp Corporation) in which a process speed was set at 225 mm/second was replaced with a semiconductor laser (image is written by a polygon mirror) of 405 nm and the prepared photoconductors were respectively mounted on the digital copier. After 50000 sheets of images were formed, a film thickness d1 of a photosensitive layer was measured, and a difference between this film thickness and a film thickness d0 of the photosensitive layer at the time of preparing the photosensitive layer was determined as a reduction in film thickness Δd (=d0−d1) and made as an evaluation index of a printing durability.

(3) Overall Evaluation

Along the aforementioned evaluation items (1) and (2), an overall evaluation of the photoconductor was performed, and each example was rated at an evaluation index of "G": good, "B": bad or "VB": very bad.

These results of evaluations are shown in the following table.

TABLE 3

| | Charge generation material | Charge transport material compound | A/B | Intitial stage 22° C./65% RH V0 (V) | Intitial stage 22° C./65% RH VL (V) | Intitial stage 5° C./10% RH VL (V) | Fatigue characteristic 22° C./65% RH V0 (V) | Fatigue characteristic 22° C./65% RH ΔVLS (V) | Printing durability evaluation Δ d | Overall evaluation |
|---|---|---|---|---|---|---|---|---|---|---|
| Example 1 | Y type oxotitanium phthalocyanine | 1 | 10/18 | −550 | −40 | −54 | −542 | 20 | 2.1 | G |
| Example 2 | Y type oxotitanium phthalocyanine | 2 | 10/18 | −550 | −41 | −55 | −542 | 21 | 2.1 | G |
| Example 3 | Y type oxotitanium phthalocyanine | 3 | 10/18 | −552 | −43 | −57 | −545 | 24 | 1.6 | G |
| Example 4 | Y type oxotitanium phthalocyanine | 4 | 10/18 | −551 | −43 | −57 | −546 | 25 | 1.5 | G |

TABLE 3-continued

| | Charge generation material | Charge transport material compound | A/B | Intitial stage 22° C./65% RH V0 (V) | Intitial stage 22° C./65% RH VL (V) | Intitial stage 5° C./10% RH VL (V) | Fatigue characteristic 22° C./65% RH V0 (V) | Fatigue characteristic 22° C./65% RH ΔVLS (V) | Printing durability evaluation Δ d | Overall evaluation |
|---|---|---|---|---|---|---|---|---|---|---|
| Example 5 | Y type oxotitanium phthalocyanine | 5 | 10/18 | −550 | −46 | −60 | −542 | 27 | 1.6 | G |
| Example 6 | X type nonmetal phthalocyanine | 1 | 10/18 | −552 | −46 | −63 | −542 | 29 | 1.5 | G |
| Comparative Example 1 | Y type oxotitanium phthalocyanine | 6 | 10/18 | −550 | −56 | −72 | −537 | 42 | 1.6 | B |
| Comparative Example 2 | Y type oxotitanium phthalocyanine | 7 | 10/18 | not evaluated because of crystallization of coating film | | | | | | VB |
| Comparative Example 3 | Y type oxotitanium phthalocyanine | 1 | 10/11 | −538 | −38 | −53 | −526 | 19 | 3.2 | B |
| Comparative Example 4 | Y type oxotitanium phthalocyanine | 2 | 10/35 | −563 | −60 | −78 | −551 | 42 | 1.2 | B |

As shown in Table 3, it was found that when the bisamine compound was used for the charge transport material as in Examples 3 and 4 among the photoconductors (Examples 1 to 6) of the present invention, the printing durability is extremely excellent while maintaining electric characteristics.

Further, it was found that the photoconductor of the present invention is superior in residual potential and sensitivity in the L/L circumstance to the photoconductor, in which a bisamine compound having a narrower conjugated system and a slower charge mobility than the compounds 1 to 5 used in the present invention is used in the charge transport material, as in Comparative Example 1.

Also, it was found that Comparative Example 3 in a similar system, in which the ratio A/B of the charge transport material A to the binder resin B is larger than that of the photoconductor of the present invention in a proportion of A, is higher in sensitivity than Example 1, but is lower in printing durability. On the other hand, it was found that Comparative Example 4, in which the ratio A/B is smaller than that of the photoconductor of the present invention in a proportion of A, is extremely higher in printing durability than the photoconductor of the present invention, but is lower in sensitivity and stability in repeated use.

As described above, in accordance with the present invention, by containing a bisamine compound as the charge transport material, it is possible to provide an electrophotographic photoconductor having a high printing durability capable of providing an image which has a high sensitivity and a high responsivity and is stable for a long period. Also, in accordance with the present invention, it is possible to provide an electrophotographic photoconductor which has advantages of an organic-based photoconductor such that the organic-based photoconductor is highly transparent and lightweight, and has an excellent film forming property and an ability to be positively and negatively charged, and is easy to be produced, and has an excellent characteristic of hardly causing a reduction in photosensitivity even in repetitive use, and an image forming apparatus including the photoconductor.

What is claimed is:

1. An electrophotographic photoconductor comprising a charge generation layer containing a charge generation material and a charge transfer layer containing a charge transfer material laminating in this order on a conductive support with an undercoat layer interposed between the charge generation layer and the conductive support, or comprising a monolayer type photosensitive layer containing a charge generation material and a charge transport material being formed on a conductive support with an undercoat layer interposed between the monolayer type photosensitive layer and the conductive support, wherein the charge transport layer or the monolayer type photosensitive layer contains, as a charge transfer material, a bisamine compound represented by the following general formula (I):

(I)

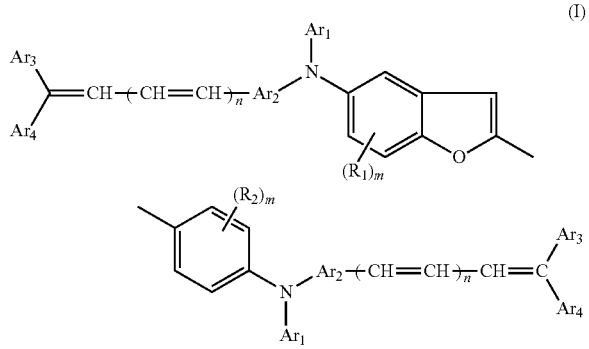

wherein $Ar_1$s each represent a phenyl or naphthyl group which may be substituted with one or more halogen atoms, or one or more straight or branched chain $C_1$ to $C_4$ alkyl or $C_1$ to $C_4$ alkoxy groups, $Ar_2$s each are an arylene group selected from the group consisting of phenylene, naphthylene and biphenylene which may be substituted with one or more halogen atoms or one or more straight or branched chain $C_1$ to $C_4$ alkyl or $C_1$ to $C_4$ alkoxy groups; or each are a heteroarylene group selected from the group consisting of a furylene, thienylene and thiazolylene which may be substituted with one or more halogen atoms, or one or more straight or branched chain $C_1$ to $C_4$ alkyl or $C_1$ to $C_4$ alkoxy groups, $Ar_3$s and $Ar_4$s may be the same or different and each are a hydrogen atom, or a straight or branched chain $C_1$ to $C_4$ alkyl group which may be substituted with one or more substituents, whose substituent is halogen atom, or one or more straight or branched chain $C_1$ to $C_4$ alkyl groups or $C_1$ to $C_4$ alkoxy; or an aryl group selected from the group consisting of a phenyl, naphthyl and biphenyl group which may be substituted with one or more halogen atoms or one or more straight or branched chain $C_1$ to $C_4$ alkyl or $C_1$ to $C_4$ alkoxy groups, $R_1$ and $R_2$ are respectively an alkyl group selected from the group consisting of a methyl, ethyl, n-propyl, isopropyl, n-butyl and t-butyl group which may be substituted with halogen atom, and m is an integer of 0 or 1 and n is an integer of 1 to 4.

2. The electrophotographic photoconductor according to claim 1, wherein in the general formula (I), $Ar_1$s each represent a phenyl or naphthyl group, $Ar_2$s each are a phenylene or naphthylene group which may be substituted with methyl, ethyl, methoxy or ethoxy group, $Ar_3$s and $Ar_4$s may be the same or different and each are a hydrogen atom, or a phenyl or naphthyl group which may be substituted with one or more halogen atoms, or one or more straight or branched chain $C_1$ to $C_4$ alkyl or $C_1$ to $C_4$ alkoxy groups, $R_1$ and $R_2$ are respectively an alkyl group selected from the group consisting of a methyl, ethyl, n-propyl, isopropyl, n-butyl and t-butyl group which may be substituted with halogen atom, and m is an integer of 0 or 1 and n is an integer of 1 to 4.

3. The electrophotographic photoconductor according to claim 1, wherein in the general formula (I), $Ar_1$s each represents a phenyl group, $Ar_2$s each are 1,4-phenylene, 2-methyl-1,4-phenylene, 3-methyl-1,4-phenylene or 1,4-naphthylene group, $Ar_3$s and $Ar_4$s may be the same or different and each are hydrogen atoms or phenyl group, and m is 0 and n is an integer of 1 or 2.

4. The electrophotographic photoconductor according to claim 1, wherein the charge generation material contains oxotitanium phthalocyanine in which a Bragg angle ($2\theta \pm 0.2$ degree) in a Cu-K$\alpha$ characteristic X-ray diffraction (wavelength: 1.54 angstroms) has a clear diffraction peak at least at 27.2 degree.

5. The electrophotographic photoconductor according to claim 1, wherein the charge transport layer further contains a binder resin, and in the charge transport layer, a ratio A/B (by mass) of the charge transport material (A) to the binder resin (B) is 10/12 or more and 10/30 or less.

6. An image forming apparatus comprising the electrophotographic photoconductor according to claim 1, a charging means for charging the electrophotographic photoconductor, an exposure means for exposing the charged electrophotographic photoconductor with light to form an electrostatic latent image, a developing means for developing the electrostatic latent image to form a toner image, a transfer means for transferring the formed toner image to a medium, a cleaning means for removing and recovering a toner remaining on the photoconductor, a fixing means for fixing the toner image transferred to a medium to the medium and a charge-removing means for removing a surface charge remaining in the photoconductor.

* * * * *